US011127578B2

(12) United States Patent
Cheng et al.

(10) Patent No.: US 11,127,578 B2
(45) Date of Patent: Sep. 21, 2021

(54) ION GUIDING DEVICE AND RELATED METHOD

(71) Applicant: SHIMADZU CORPORATION, Kyoto (JP)

(72) Inventors: Yupeng Cheng, Shanghai (CN); Xiaoqiang Zhang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 95 days.

(21) Appl. No.: 16/605,266

(22) PCT Filed: Jul. 24, 2017

(86) PCT No.: PCT/JP2017/026695
§ 371 (c)(1),
(2) Date: Oct. 15, 2019

(87) PCT Pub. No.: WO2019/003456
PCT Pub. Date: Jan. 3, 2019

(65) Prior Publication Data

US 2021/0134575 A1 May 6, 2021

(30) Foreign Application Priority Data

Jun. 29, 2017 (CN) ..... 201710512171.6

(51) Int. Cl.
*H01J 49/06* (2006.01)

(52) U.S. Cl.
CPC ..... *H01J 49/063* (2013.01)

(58) Field of Classification Search
CPC ..... H01J 49/063
See application file for complete search history.

(56) References Cited

U.S. PATENT DOCUMENTS 5,847,386 A 12/1998 Thomson et al.
6,576,897 B1 6/2003 Steiner et al.
(Continued)

FOREIGN PATENT DOCUMENTS

CN 101669027 A 3/2010
CN 103151236 A 6/2013
(Continued)

OTHER PUBLICATIONS

SIPO, "Chinese Office Action and Search Report for CN Application No. 201710512171.6", China, dated Jun. 8, 2020.
(Continued)

*Primary Examiner* — Nicole M Ippolito
*Assistant Examiner* — Hanway Chang
(74) *Attorney, Agent, or Firm* — Locke Lord LLP; Tim Tingkang Xia, Esq.

(57) ABSTRACT

The ion guiding device comprises a first electrode assembly comprising two parallel electrode units arranged along a spatial axis; a second electrode assembly comprising at least two non-parallel electrode units arranged in a plane between the parallel electrode units along the spatial axis, wherein a space enclosed by the first electrode assembly and second electrode assembly forms an ion transmission channel along the spatial axis; and, a power supply device, which is configured to apply RF voltages with different polarities to the first electrode assembly and the second electrode assembly to generate a RF electric field in the directions perpendicular to the spatial axis to confine ions, and separately apply DC voltages to the first electrode assembly and the second electrode assembly to generate a certain DC voltage difference, to generate a DC electric field along the spatial axis to control the movement of ions.

26 Claims, 8 Drawing Sheets

(56) References Cited

U.S. PATENT DOCUMENTS

| | | | |
|---|---|---|---|
| 6,891,157 | B2 | 5/2005 | Bateman et al. |
| 7,675,031 | B2 | 3/2010 | Konicek et al. |
| 7,923,681 | B2 | 4/2011 | Collings et al. |
| 8,084,750 | B2 | 12/2011 | Muntean |
| 8,455,814 | B2 | 6/2013 | Loucks, Jr. et al. |
| 2005/0056778 | A1 | 3/2005 | Thomson et al. |
| 2008/0265154 | A1 | 10/2008 | Cousins et al. |
| 2009/0159796 | A1 | 6/2009 | Belford et al. |
| 2014/0048695 | A1 | 2/2014 | Giles et al. |
| 2014/0312243 | A1 | 10/2014 | Kalinitchenko |
| 2015/0048246 | A1 | 2/2015 | Green et al. |
| 2015/0323500 | A1 | 11/2015 | Davis et al. |
| 2017/0125231 | A1 | 5/2017 | Giles et al. |

FOREIGN PATENT DOCUMENTS

| | | | |
|---|---|---|---|
| CN | 106373854 | A | 2/2017 |
| JP | 2005-536021 | A | 11/2005 |
| JP | 2014-506720 | A | 3/2014 |
| JP | 2014-532965 | A | 12/2014 |
| JP | 2014-534562 | A | 12/2014 |
| WO | 2012124041 | A1 | 9/2012 |
| WO | 2015189539 | A1 | 12/2015 |
| WO | 2017013832 | A1 | 1/2017 |

OTHER PUBLICATIONS

EPO (ISR/EP), "International Search Report for PCT Application No. PCT/JP2017026695", NL, dated Mar. 21, 2018.

JPO, "Japanese Office Action for Application No. JP 2019-561194", Japan, dated Oct. 16, 2020.

SIPO, "Chinese Office Action and Search Report for CN Application No. 201710512171.6", China, dated Nov. 29, 2019.

[Fig. 1]
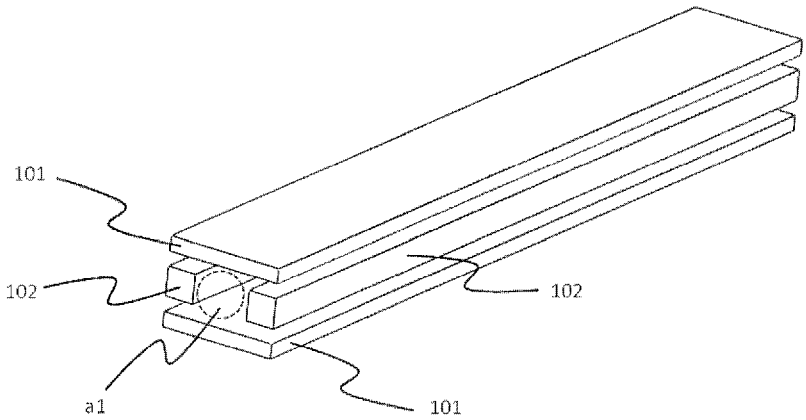
[Fig. 2]
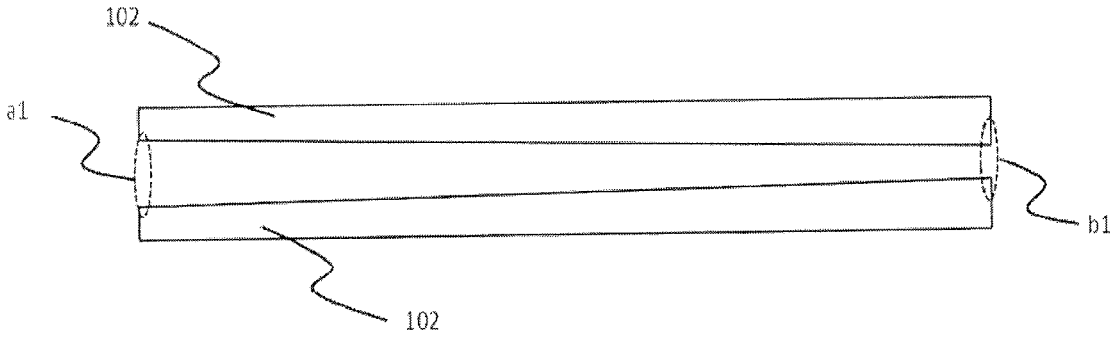

[Fig. 3]
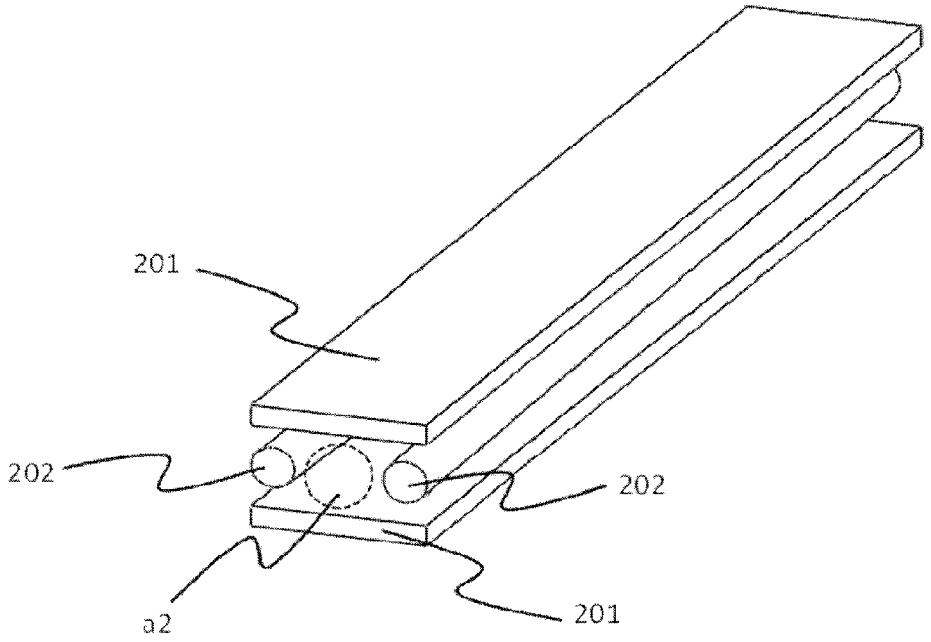
[Fig. 4]
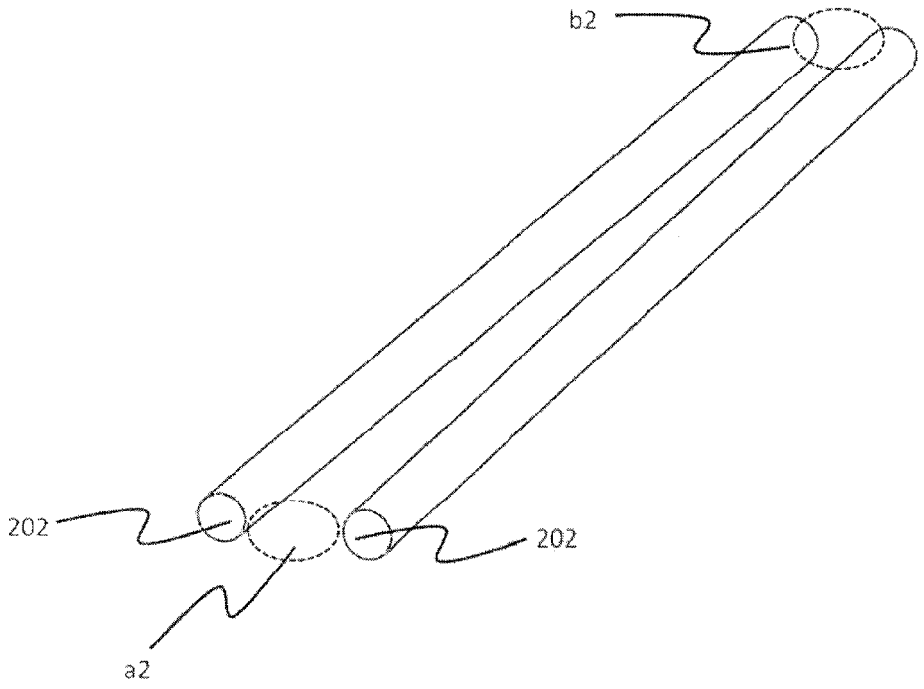

[Fig. 5]
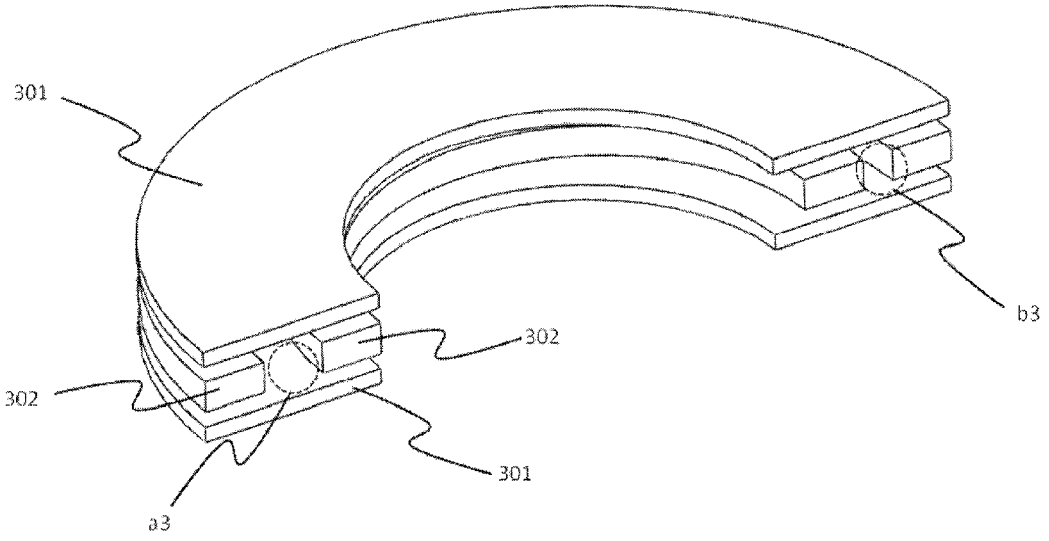
[Fig. 6]
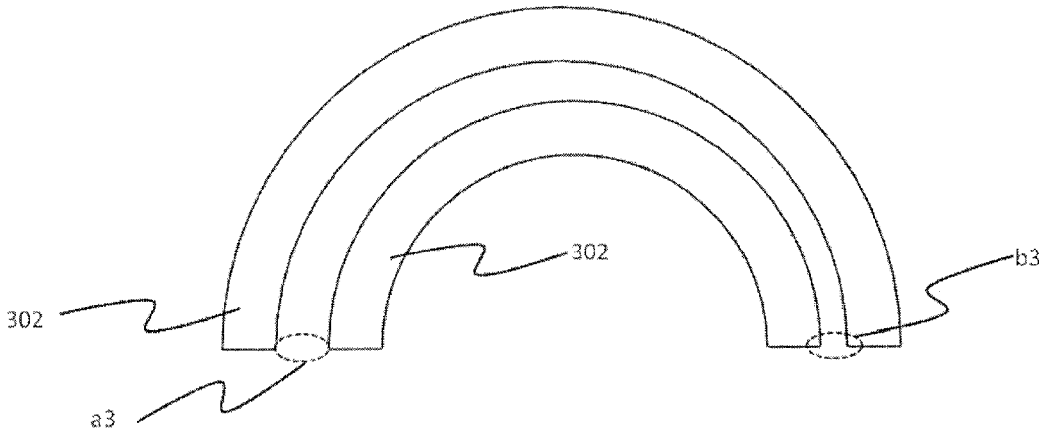

[Fig. 7]
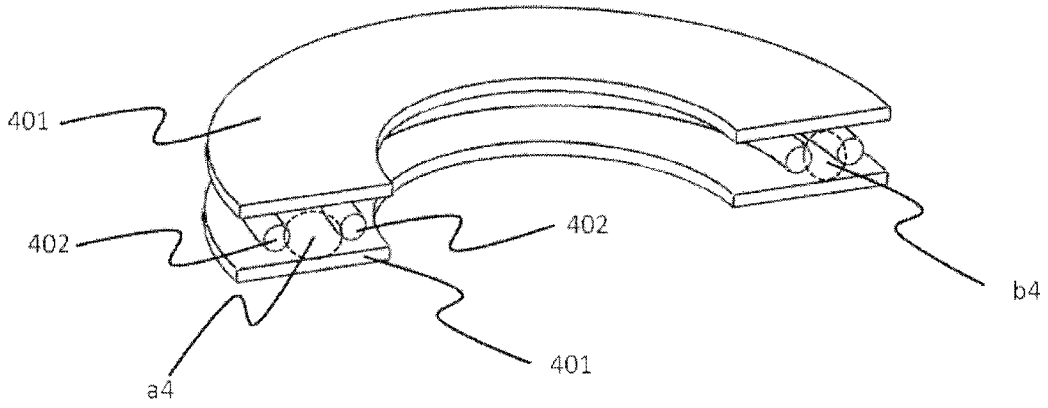
[Fig. 8]
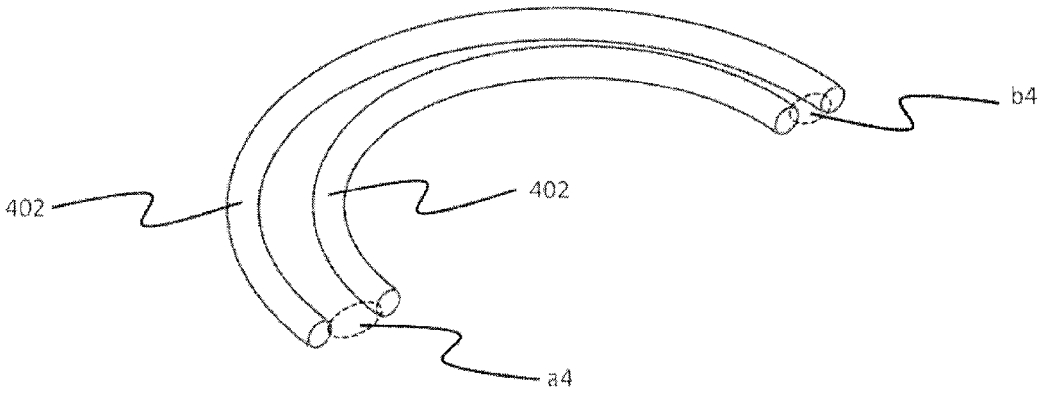

[Fig. 9]
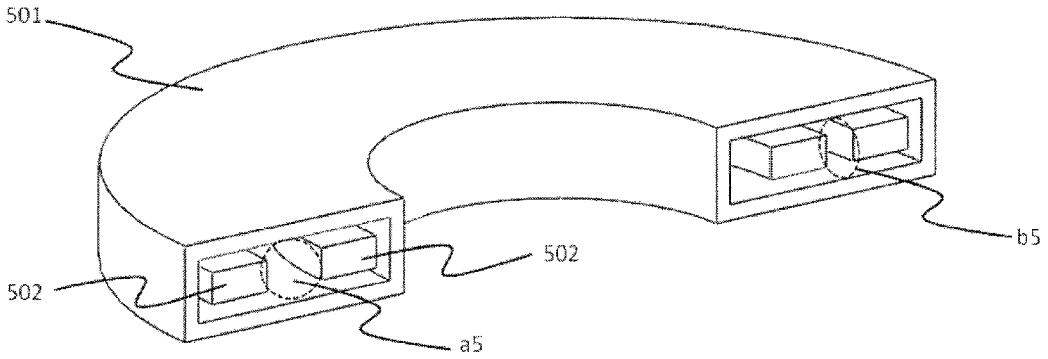
[Fig. 10]
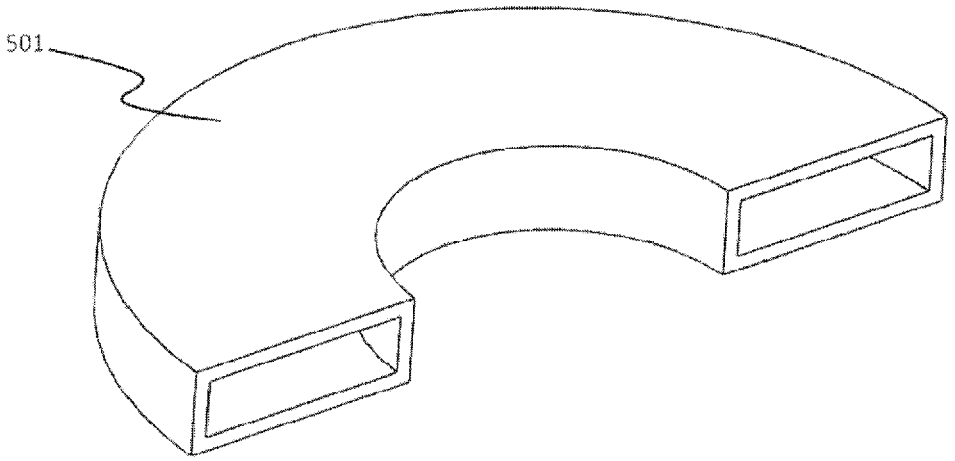

[Fig. 11]
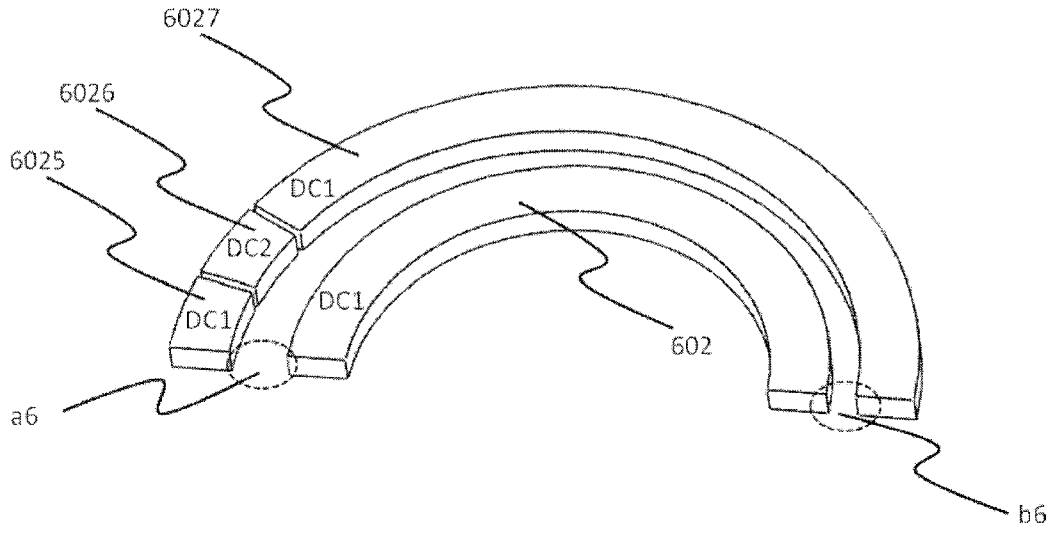
[Fig. 12]
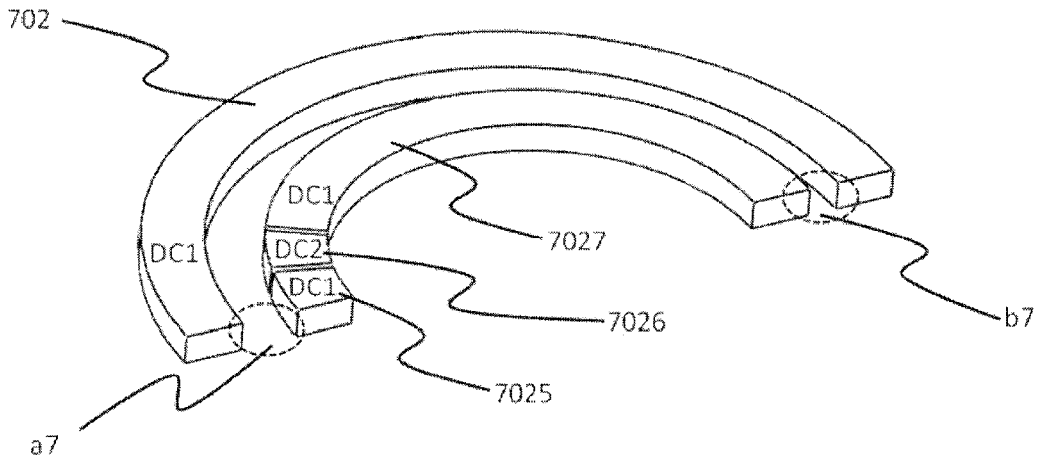

[Fig. 13]
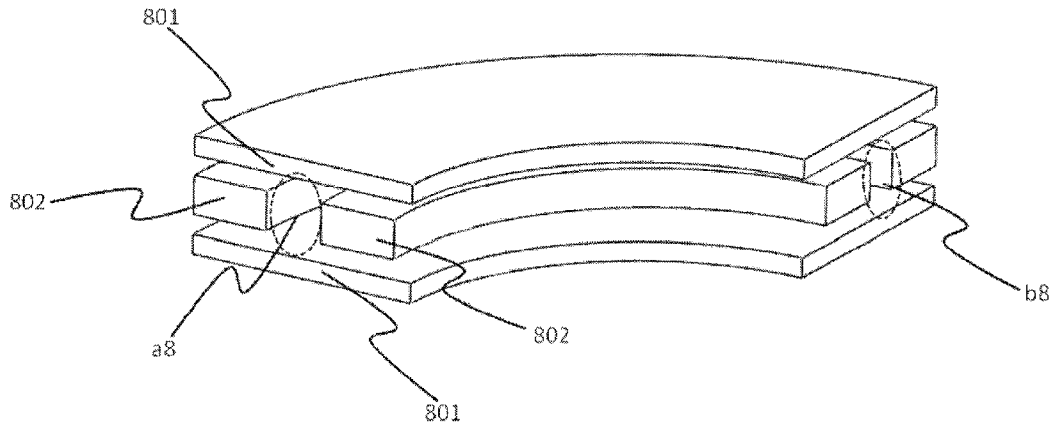
[Fig. 14]
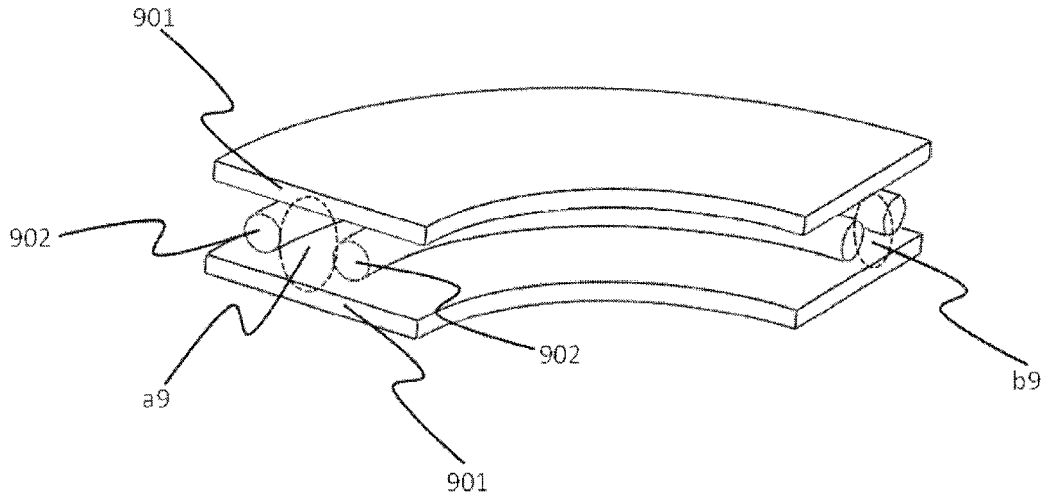

[Fig. 15]
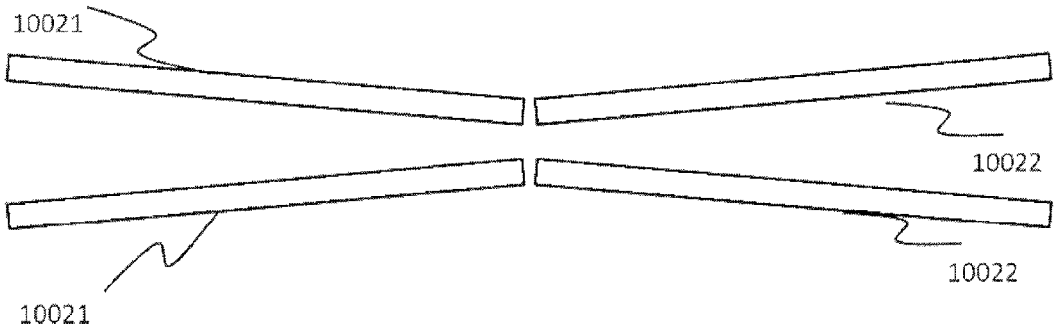
[Fig. 16]
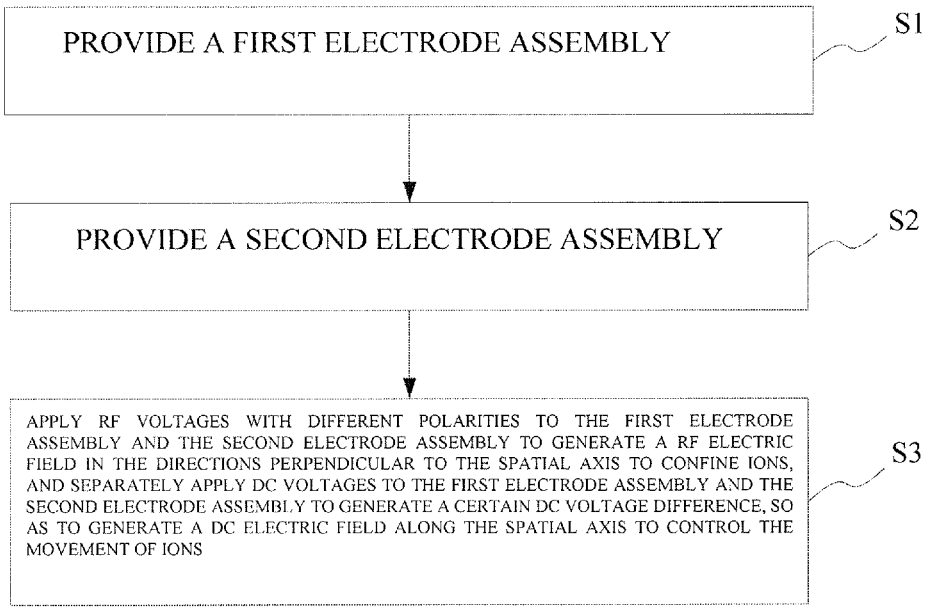

ION GUIDING DEVICE AND RELATED METHOD

CROSS-REFERENCE TO RELATED PATENT APPLICATIONS

This application is a U.S. national stage entry of PCT Application Ser. No. PCT/JP2017/026695, filed Jul. 24, 2017, which claims priority to and the benefit of, Chinese Patent Application Serial No. 201710512171.6, filed Jun. 29, 2017, which are incorporated herein by reference in their entireties.

FIELD OF THE INVENTION

The present invention relates to the technical field of ion guiding, and in particular to an ion guiding device and an ion guiding method.

BACKGROUND OF THE INVENTION

In the prior arts, various ion guiding devices have been developed and widely applied in various mass spectrometers to realize the transmission, focusing and other manipulations of ions under various gas pressure conditions. Due to their advantages of simple structure, good ion focusing effect and so on, quadrupole ion guide becomes the most commonly used ion guiding device. Similarly, multipole ion guiding devices such as hexapole and octopole are usually used as preceding-stage ion guiding devices of mass spectrometers, instead of quadrupole rods, to realize high-flux ion transmission.

However, such devices have a common disadvantage that the axial transmission of ions is merely driven by the initial kinetic energy of the ions or an axial airflow due to the lack of an axial driving electric field. In the case of a very low gas pressure (generally below 1 Pa), the mean free path of ions is relatively long, and the long-distance transmission driven by the initial kinetic energy of the ions still can be realized within a short period of time. In addition, in the case of a relatively high gas pressure (at least above 10 Pa), there is often an obvious airflow, and ions may be directionally transmitted under the drive of the airflow. However, generally, under a gas pressure between 1 Pa and 10 Pa, it often takes a long period of time for ions to pass through an ion guiding device. In addition, if the ions dwell in the ion guiding device for a too long time, not only the analysis speed of instruments will be influenced, but also a certain ion loss will be caused to decrease the sensitivity of the instruments. Moreover, due to the lack of axial electric field for driving, such ion guiding devices are generally limited to use a linear structure. Consequently, the overall length of the instruments is relatively long.

In the U.S. Pat. No. 5,847,386A, Bruce A. Thomson et al. have disclosed an ion guiding technique based on quadrupole, wherein an axial electric field is generated inside the ion guiding device by various methods such as, by gradually changing the radius of quadrupole electrodes, obliquely placing the electrodes, dividing the electrodes into a plurality of segments and additionally providing auxiliary electrodes between adjacent electrodes, so as to accelerate the transmission of ions in the axial direction.

In the U.S. Pat. No. 7,675,031B2, Michael Konicek et al. have disclosed an ion guiding device capable of providing an axial electrical field for realizing quick transmission of ions, wherein the typical structure is that four sets of auxiliary electrodes are additionally provided between two adjacent electrodes of a quadrupole, and each set of auxiliary electrodes consists of a plurality of finger electrodes. By applying a DC potential gradient to the finger electrodes, an axial driving electric field may be generated inside the device, so the ions may be transmitted quickly, and the direction of movement of the ions in the device may be controlled conveniently.

In addition, the ion acceptance area and the ion focusing capability of device such as quadrupole rods are related to the radius of the RF field of the devices, and are mutually restricted. Therefore, generally, it is required to balance the actual performances of the two by making a compromise. In U.S. Pat. No. 8,455,814B2, Harvey D. Loucks et al. have disclosed a hexapole device with a gradually converged sectional area. Since the radius of this device at the entrance is larger than that at the exit, the problem of mutual restriction of the ion acceptance area and the ion focusing is properly solved. Meanwhile, in this device, a high-resistance layer is coated on the electrodes. By applying a DC voltage difference to two ends of the electrodes, an axial electric field may be established inside the device to drive ions, so that a curved ion guiding structure may be realized. It is well-known that the curved ion guiding device can reduce the interference from neutral molecules and improve the signal-to-noise ratio of the instrument, and moreover, make the structural design of the whole instrument more flexible, which is beneficial for the overall length reduction of the instrument.

However, there are still some new challenges when the curved ion guiding device is used as a collision cell. To increase the dissociation efficiency of parent ions in the collision cell, the parent ions are generally accelerated to obtain relatively high kinetic energy (tens to hundreds of electron volts), and then injected into the collision cell to collide with collision gas molecules so as to induce a dissociation process. However, when the kinetic energy of the parent ions is too high, the parent ions are very likely to escape from the RF field and thus directly hit the electrodes to result in ion loss. Due to the limitation of the breakdown voltage in the vacuum environment, it is unable to enhance the confinement of ions only by increasing the RF voltage. To improve the transmission efficiency of high kinetic energy ions in a curved ion guiding device without influencing the dissociation efficiency of parent ions, in the U.S. Pat. No. 7,923,681B2, Bruce A. Collings et al. have proposed a structure for connecting a straight ion guiding section with a curved ion guiding section. Firstly, high-speed parent ions enter the straight ion guiding section for collision and dissociation. The frequent collisions of ions with the collision gas molecules will greatly reduce the kinetic energy of ions. After the ions enter the curved ion guiding section, the RF electric field is sufficient to confine the ions. Although this method may properly solve the problems caused by the high-speed injection of the ions, compromise is made to a certain extent with respect to the issue of shortening the length of the instrument. Moreover, the length of the ion guiding device itself also becomes longer.

In the U.S. Pat. No. 8,084,750B2, Felician Muntean has proposed a curved ion guiding device by dividing a curved quadrupole into a plurality of segments and applying an additional DC voltage to the segmented electrodes in the outer circle, or by placing an auxiliary electrode on the side of outer circle of the curved quadrupole and applying a DC voltage to the auxiliary electrode. Thus, a radial electrical field is generated to assist ion deflection. Although this device may properly solve the above problems, either the device is very complicated in structure and difficult to process or the axial driving electric field and the radial deflection electric field are coupled together and difficult to control. As a result, the comprehensive performance is affected to a certain extent.

In addition, to realize a better collision-induced dissociation effect, a special collision gas, for example, nitrogen, argon and so on, is generally fed into the collision cell, and maintained at a certain gas pressure. In order to isolate the collision cell from a chamber in which other ion optical devices are placed, the collision cell is generally disposed in another enclosed and independent vacuum chamber. Meanwhile, one or more sheet electrodes having only one aperture in the middle point are provided at the inlet and outlet of the collision cell so that it is convenient to limit the conductance of gas flow at the inlet and outlet of collision cell and maintain the pressure in the chamber. However, the flux of ions is also reduced as the conductance of gas flow is limited. In the U.S. Pat. No. 6,576,897B1, Urs Steiner et al. have disclosed a curved ion guiding device without the sheet electrodes with aperture, wherein gaps between adjacent electrodes of the quadrupole are filled with vacuum sealant so that the ion channel is isolated from the outside to form a relatively enclosed space. Since the main inlet for the collision gas is located approximately in the middle of the quadrupole, a stable pressure region may be formed in the middle part away from the inlet and outlet so as to perform collision-induced dissociation for the parent ions. However, this device is still limited by many problems. For example, the gas pressure shall not be too high, and it is unable to provide an axial driving electrical field as well as a radial deflection electric field.

SUMMARY OF THE INVENTION

In view of the deficiencies in the prior art, an objective of the present invention is to provide an ion guiding device and an ion guiding method. The ion guiding device includes a pair of parallel electrodes arranged along a certain spatial axis and a pair of non-parallel electrodes forming a certain angle with respect to the spatial axis, so a curved ion guiding structure is realized, and an electric field in both the axial direction and the radial direction may be further provided to flexibly control the movement of ions. Meanwhile, various requirements for the ion guiding device, particularly when used as a collision cell, are satisfied.

To achieve this objective and other related objectives, the present invention provides an ion guiding device, including: a first electrode assembly, including two parallel electrode units arranged along a spatial axis; a second electrode assembly, including at least two non-parallel electrode units arranged in a plane between the parallel electrode units along the spatial axis, wherein a space enclosed by the first electrode assembly and the second electrode assembly forms an ion transmission channel along the spatial axis; and, a power supply device configured to apply RF voltages with different polarities to the first electrode assembly and the second electrode assembly to generate a RF electric field in the directions perpendicular to the spatial axis to confine ions, and separately apply DC voltages to the first electrode assembly and the second electrode assembly to generate a certain DC voltage difference, so as to generate a DC electric field along the spatial axis to control the movement of ions.

In an embodiment of the present invention, the ion transmission channel has a larger ion inlet and smaller ion outlet.

In an embodiment of the present invention, the cross-sectional area of the ion transmission channel gradually changes along the spatial axis.

In an embodiment of the present invention, the RF voltages applied to the first electrode assembly and the second electrode assembly by the power supply device are different in at least one of phase, amplitude and frequency.

In an embodiment of the present invention, the waveform of the RF voltages is one of sine wave, square wave, sawtooth wave and triangular wave.

In an embodiment of the present invention, the working pressure range of the ion guiding device is one or more of $[2\times10^5, 2\times10^3]$ Pa, $[2\times10^3, 20]$ Pa, $[20, 2]$ Pa, $[2, 2\times10^{-1}]$ Pa, $[2\times10^{-1}, 2\times10^{-3}]$ Pa and less than $2\times10^{-3}$ Pa.

In an embodiment of the present invention, the electrode units in the first electrode assembly are one of plate electrodes, rod electrodes, and thin-layer electrodes attached to a PCB or a ceramic substrate, or a combination thereof.

In an embodiment of the present invention, the spatial axis is a straight axis, a curved axis or a combination thereof.

In an embodiment of the present invention, as the second electrode assembly, round rod electrodes or plate electrodes are used.

In an embodiment of the present invention, the two parallel electrode units in the first electrode assembly are replaced with a tubular electrode including two parallel surfaces.

In an embodiment of the present invention, at least one electrode unit in the second electrode assembly includes at least one electrode segment, and the power supply device applies different DC voltages and a same RF voltage to adjacent electrode segments.

In an embodiment of the present invention, the ion guiding device is used as one of preceding-stage ion guiding device, ion compression device, ion storage device, collision cell and ion buncher device of a mass spectrometer, or a combination thereof.

In an embodiment of the present invention, the second electrode assembly includes one or more pairs of non-parallel electrode units arranged in a certain plane between the parallel electrode units along the spatial axis.

Correspondingly, the present invention further provides an ion guiding device, including the following steps of:

providing a first electrode assembly, the first electrode assembly including two parallel electrode units arranged along a spatial axis;

providing a second electrode assembly, the second electrode assembly including at least two non-parallel electrode units arranged in a plane between the parallel electrode units along the spatial axis, wherein a space enclosed by the first electrode assembly and the second electrode assembly forms an ion transmission channel along the spatial axis;

applying RF voltages with different polarities to the first electrode assembly and the second electrode assembly to generate a RF electric field in a direction perpendicular to the spatial axis to confine ions, and separately applying DC voltages to the first electrode assembly and the second electrode assembly to generate a certain DC voltage difference, so as to generate a DC electric field along the spatial axis to control the movement of ions.

In an embodiment of the present invention, the ion transmission channel has larger ion inlet and smaller ion outlet.

In an embodiment of the present invention, the cross-sectional area of the ion transmission channel gradually changes along the spatial axis.

In an embodiment of the present invention, the RF voltages applied to the first electrode assembly and the second electrode assembly are different in at least one of phase, amplitude and frequency.

In an embodiment of the present invention, the waveform of the RF voltages is one of sine wave, square wave, sawtooth wave and triangular wave.

In an embodiment of the present invention, the working pressure range in the ion guiding method is one or more of $[2\times10^5, 2\times10^3]$ Pa, $[2\times10^3, 20]$ Pa, [20, 2] Pa, $[2, 2\times10^{-1}]$ Pa, $[2\times10^{-1}, 2\times10^{-3}]$ Pa and less than $2\times10^{-3}$ Pa.

In an embodiment of the present invention, the electrode units in the first electrode assembly are one of plate electrodes, rod electrodes, and thin-layer electrodes attached to a PCB or a ceramic substrate, or a combination thereof.

In an embodiment of the present invention, the spatial axis is a straight axis, a curved axis or a combination thereof.

In an embodiment of the present invention, as the second electrode assembly, round rod electrodes or plate electrodes are used.

In an embodiment of the present invention, the two parallel electrode units in the first electrode assembly are replaced with a tubular electrode including two parallel surfaces.

In an embodiment of the present invention, at least one electrode unit in the second electrode assembly includes at least one electrode segment, and different DC voltages and a same RF voltage are applied to adjacent electrode segments.

In an embodiment of the present invention, the second electrode assembly includes one or more pairs of non-parallel electrode units arranged in a certain plane between the parallel electrode units along the spatial axis.

As described above, the ion guiding device and the ion guiding method of the present invention have the following beneficial effects:

(1) a pair of parallel electrodes arranged along a spatial axis and a pair of non-parallel electrodes forming a certain angle with the spatial axis are included, and the cross-sectional area of an ion transmission channel enclosed by the pair of parallel electrodes and the pair of non-parallel electrodes gradually changes along the spatial axis; moreover, by applying RF voltages with different polarities to the pair of parallel electrodes and the pair of non-parallel electrodes and applying a DC voltage difference between the pair of parallel electrodes and the pair of non-parallel electrodes, a RF electric field in the directions perpendicular to the axial direction may be generated within the ion channel to confine ions, and a DC electric field in the axial direction may also be generated to drive the ion transmission;

(2) the transmission speed of ions can be effectively improved, and an off-axis ion optics can be realized conveniently, so that the signal-to-noise ratio of the ion guiding device is increased greatly, and the overall length of the instrument is shortened;

(3) Moreover, the structure is simple, and the operation is easy.

BRIEF DESCRIPTION OF THE DRAWINGS

FIG. 1 shows a structure diagram of Embodiment 1 of an ion guiding device according to the present invention.

FIG. 2 shows a structure diagram of a second electrode assembly in Embodiment 1 of the ion guiding device according to the present invention.

FIG. 3 shows a structure diagram of Embodiment 2 of the ion guiding device according to the present invention.

FIG. 4 shows a structure diagram of a second electrode assembly in Embodiment 2 of the ion guiding device according to the present invention.

FIG. 5 shows a structure diagram of Embodiment 3 of the ion guiding device according to the present invention.

FIG. 6 shows a structure diagram of a second electrode assembly in Embodiment 3 of the ion guiding device according to the present invention.

FIG. 7 shows a structure diagram of Embodiment 4 of the ion guiding device according to the present invention.

FIG. 8 shows a structure diagram of a second electrode assembly in Embodiment 4 of the ion guiding device according to the present invention.

FIG. 9 shows a structure diagram of Embodiment 5 of the ion guiding device according to the present invention.

FIG. 10 shows a structure diagram of a first electrode assembly in Embodiment 5 of the ion guiding device according to the present invention.

FIG. 11 shows a structure diagram of a second electrode assembly in Embodiment 6 of the ion guiding device according to the present invention.

FIG. 12 shows a structure diagram of a second electrode assembly in Embodiment 7 of the ion guiding device according to the present invention.

FIG. 13 shows a structure diagram of Embodiment 8 of an ion guiding device according to the present invention.

FIG. 14 shows a structure diagram of Embodiment 9 of an ion guiding device according to the present invention.

FIG. 15 shows a structure diagram of a second electrode assembly in Embodiment 10 of the ion guiding device according to the present invention.

FIG. 16 shows a flowchart of an ion guiding method according to the present invention.

DETAILED DESCRIPTION OF THE INVENTION

Implementations of the present invention will be described below through specific embodiments, and other advantages and effects of the present invention may be easily obtained by those skilled in the art from the contents disclosed in the description.

It is to be noted that, the structure, scale, size and the like shown in the accompanying drawings of the description are merely used for allowing those skilled in the art to understand and read the contents disclosed in the description and not intended to limit the implementable conditions of the present invention, and thus have no any technically substantive meaning. Without influencing the effects and objectives which may be achieved by the present invention, any structural modification, changes in scale, or size adjustments shall fall within the scope defined by the technical contents of the present invention. Meanwhile, terms such as "upper", "lower", "left", "right", "middle" and "one" used in the description are merely used for clear statement and not intended to limit the implementable scope of the present invention, and any changes or adjustments in relative relations, in case of not substantively changing the technical contents, shall be regarded as falling within the implementable scope of the present invention.

The present invention provides an ion guiding device, including: a first electrode assembly, the first electrode assembly including two parallel electrode units arranged along a spatial axis; a second electrode assembly, the second electrode assembly including at least two non-parallel electrode units arranged in a plane between the parallel electrode units along the spatial axis, wherein a space enclosed by the first electrode assembly and second electrode assembly forms an ion transmission channel along the spatial axis; and, a power supply device, which is configured to apply RF voltages with different polarities to the first electrode assembly and second electrode assembly to generate a RF electric field in the directions perpendicular to the spatial axis to confine ions, and separately apply DC voltages to the first electrode assembly and second electrode assembly to generate a certain DC voltage difference, so as to generate a DC electric field along the spatial axis to control the movement of ions. It is to be noted that, when the second electrode assembly includes more than two non-parallel electrode units, the non-parallel electrode units are arranged along an axial extension of the spatial axis.

The ion guiding device of the present invention will be further described below through specific embodiments.

Embodiment 1

As shown in FIG. 1, in Embodiment 1, the ion guiding device is of a linear structure, including a first electrode assembly 101, a second electrode assembly 102 and a power supply device (not shown). Wherein, the first electrode assembly 101 includes a pair of parallel electrode units arranged along a spatial axis, and the second electrode assembly 102 includes at least two non-parallel electrode units arranged in a parallel plane between the parallel electrode units along the spatial axis. Hence, the first electrode assembly 101 and the second electrode assembly 102 form an ion transmission channel along the spatial axis, with a larger ion inlet a1 and a smaller ion outlet b1, as shown in FIG. 2. In this embodiment, as the second electrode assembly 102, square rod electrodes or plate electrodes are used, and the second electrode assembly 102 has a rectangular cross-section.

The power supply device applies RF voltages with the same amplitude and frequency and opposite polarities to the first electrode assembly 101 and second electrode assembly 102, so that a quadrupole field is formed inside the ion transmission channel to confine ions in the directions perpendicular to the spatial axis. Since the ion transmission channel has a larger ion inlet a1 and a smaller ion outlet b1, a large ion acceptance area is obtained, and the focusing effect of the ions is also excellent.

Preferably, the RF voltages may be different in at least one of phase, amplitude and frequency, and the waveform is one of sine wave, square wave, sawtooth wave and triangular wave.

Meanwhile, the power supply device further applies a certain DC voltage difference to the first electrode assembly and the second electrode assembly. Since the cross-sectional area of the ion transmission channel gradually changes along the spatial axis, the potential in the center axis of the ion transmission channel also changes correspondingly, so that a potential gradient is formed along the spatial axis to control the movement of ions. Specifically, in the direction from the ion inlet to the ion outlet, the cross-sectional area of the ion transmission channel decreases gradually along the spatial axis.

Preferably, the ion guiding device may operate at a particular pressure. Depending on the actual requirements, the pressure value is within one of the following ranges: a) $[2\times10^5, 2\times10^3]$ Pa; b) $[2\times10^3, 20]$ Pa; c) [20, 2] Pa; d) $[2, 2\times10^{-1}]$ Pa; e) $[2\times10^{-1}, 2\times10^{-3}]$ Pa; and, f)$<2\times10^{-3}$ Pa.

Considering some actual requirements, for example, the processing difficulty, the performance level and so on, the electrode units in the first electrode assembly 101 may be one of plate electrodes, rod electrodes, and thin-layer electrodes attached to a substrate such as a PCB or a ceramic substrate, or a combination thereof.

Embodiment 2

As shown in FIGS. 3 and 4, a main difference between the ion guiding device in Embodiment 2 and the ion guiding device in Embodiment 1 lies in that, as the second electrode assembly 202, round rod electrodes are used. The implementation of the RF voltages and the DC voltages in this embodiment is basically same as that in Embodiment 1. The advantage of using round rod electrodes is that the field form of the quadrupole field is better, so it is advantageous for confining ions in the directions perpendicular to the spatial axis. Similarly, since the ion transmission channel has a larger ion inlet a2 and a smaller ion outlet b2, a large ion acceptance area is obtained, and the focusing effect of the ions is also excellent.

It is to be noted that, as the first electrode assembly 202, round rod electrodes may also be used to further improve its performance. However, the processing difficulty will be increased.

Embodiment 3

The spatial axis may be a straight axis, a curved axis or a combination thereof. As shown in FIG. 5, in Embodiment 3, the spatial axis of the ion guiding device of the present invention is a curved axis of 180 degrees. Wherein, as the first electrode assembly 301, curved plate electrodes of 180 degrees are used. As shown in FIG. 6, the second electrode assembly 302 includes two arc electrode units which are bent 180 degrees. The two arc electrode units are not of a coaxial structure, and the spacing between the two arc electrode units decreases gradually from an ion inlet a3 to an ion outlet b3 in the direction of the spatial axis. Therefore, the cross-sectional area of the ion transmission channel formed in the curved ion guiding device also changes in the direction of the spatial axis. After the RF voltages and DC voltages are applied in a way similar to that in Embodiment 1, a RF electric field perpendicular to the spatial axis may also be formed to confine ions, and an axial DC electrical field is also formed to drive ions.

Wherein, the ion guiding device with a curved axis can decrease the neutral noise and reduce the instrument length.

Embodiment 4

Similarly, the ion guiding device with a curved axis can also be improved in performance by using round rod electrodes. In Embodiment 4, FIG. 7 shows an ion guiding device which is deflected 180 degrees and uses curved round rod electrodes as the second electrode assembly 402. Wherein, FIG. 8 shows the second electrode assembly 401 using the curved round rod electrodes. Similarly, the two round rod electrodes are not of a coaxial structure, and the spacing between the two round rod electrodes decreases gradually from an ion inlet a4 to an ion outlet b4 in the direction of the spatial axis. Therefore, the cross-sectional area of the ion transmission channel in the directions perpendicular to the spatial axis gradually changes.

It is to be noted that, as the first electrode assembly 401, curved round rod electrodes may also be used to further improve the performance.

Embodiment 5

As shown in FIG. 9, in Embodiment 5, the ion guiding device includes a first electrode assembly 501 and a second electrode assembly 502, wherein an ion inlet a5 is larger while an ion outlet b5 is smaller. As the first electrode assembly 501, a tubular electrode including two parallel surfaces is used, and it has a curved structure of 180 degrees. Since the same RF voltage and DC voltage are always applied to all the electrodes in the first electrode assembly 501, the first electrode assembly may be combined as an integral electrode in practical manufacture.

In addition, when the ion guiding device is used as a collision cell, it is required to isolate the ion guiding device from surrounding ion optical devices in vacuum. If the tubular electrode shown in FIG. 10 is used as the first electrode assembly, the ion guiding device may be used as a vacuum chamber for forming a relatively enclosed vacuum section therein. A certain amount of the collision gas is fed into the vacuum chamber, and the pressure of the collision gas within the vacuum chamber may be stabilized within a certain range. Therefore, the ion guiding device in this embodiment is simplified relative to the conventional design of the collision cell and the extra vacuum chamber is also not required. Meanwhile, less collision gas is consumed than the existing ion guiding devices due to a smaller inside space.

Embodiment 6

As shown in FIG. 11, in this embodiment, in the vicinity of the ion inlet, an outer electrode in the second electrode assembly 602 of the ion guiding device is divided into a front segment 6025, a middle segment 6026 and a rear segment 6027. The power supply device applies different DC voltages and the same RF voltage to adjacent electrode segments. In order to improve the dissociation efficiency of parent ions in the collision cell, the parent ions are generally accelerated to relatively high kinetic energy and then injected into the collision cell. Due to the limitation of the breakdown voltage in vacuum, it is unable to enhance the confinement of ions by infinitely increasing the RF voltage. Therefore, when the ions with very high kinetic energy enter the curved collision cell, the ions are very likely to escape from the confinement of the RF electric field and then hit the electrodes. In this embodiment, a DC voltage DC2 is applied to the middle segment 6026 of the outer electrode of the second electrode assembly 602, and a DC voltage DC1 is applied to the front segment 6025 and rear segment 6027 of the outer electrode as well as the inner electrode. Hence, for positive ions, a deflection electric field from the outer electrode to the inner electrode may be generated in the vicinity of the ion inlet a6, so as to assist the deflection of the ions in the curved ion guiding device. For negative ions, the deflection electric field has an opposite direction. Since the ions with high kinetic energy are continuously cooled by collisions with the collision gas after flying a certain distance in the ion transmission channel, the kinetic energy of the ions decreases continuously. When the kinetic energy of the ions decreases to a certain level, the RF electric field is sufficient to effectively confine the ions. The segmented structure in this embodiment is relatively simple. By dividing the outer electrode into three segments in the vicinity of the ion inlet a6, the deflection of the ions may be effectively assisted, and the transmission efficiency of ions with high kinetic energy may be improved during the injection. Wherein, the ion inlet a6 is larger, while the ion outlet b6 is smaller.

It is to be noted that, with regard to the ion guiding device structure in this embodiment, since the deflection of ions is adjusted only within a local region inside the ion channel, the injection and transmission processes of the ions will almost not be influenced.

Embodiment 7

As shown in FIG. 12, this embodiment is a variant of Embodiment 6. In this variant, the inner electrode used in the second electrode assembly 702 of the 180-degree curved ion guiding device is divided into a front segment 7025, a middle segment 7026 and a rear segment 7027. Similarly, a DC voltage DC2 is applied to the middle segment 7026 of the inner electrode, and a DC voltage DC1 is applied to the rear segment 7025 and rear segment 7027 of the inner electrode as well as the outer electrode. Hence, for positive ions, a deflection electrode field from the outer electrode to the inner electrode is generated in the vicinity of the ion inlet a7, so as to assist the deflection of ions in the curved ion guiding device. For negative ions, the generated deflection electric field has an opposite direction. Wherein, the ion inlet a7 is larger, while the ion outlet b7 is smaller.

Preferably, in order to prevent the application of a too high DC voltage to the middle electrode segment from influencing the stability of ions in the ion channel, in the ion guiding device of the present invention, the segmented structure mentioned above is not limited to being implemented on one of the outer electrode and the inner electrode of the second electrode assembly, and instead, both the outer electrode and the inner electrode may be segmented at different positions.

Embodiment 8

As shown in FIG. 13, this embodiment is a variant of Embodiment 3. The spatial axis of the ion guiding device is a curved axis which is bent 90 degrees, and the ion guiding device includes a first electrode assembly 801 and a second electrode assembly 802, wherein an ion inlet a8 is larger while an ion outlet b8 is smaller. The application way of various voltages in this embodiment is similar to that in Embodiment 3, for realizing the same purpose.

The ion guiding device in this embodiment has a smaller size than the ion guiding device in Embodiment 3, and a plurality of the ion guiding devices may be arbitrarily combined to realize a more flexible and complicated structure.

Embodiment 9

As shown in FIG. 14, this embodiment is a variant of Embodiment 8. The spatial axis of the ion guiding device is a curved axis which is bent 90 degrees, and the ion guiding device includes a first electrode assembly 901 and a second electrode assembly 902, wherein an ion inlet a9 is larger while an ion outlet b9 is smaller. A difference between this embodiment and Embodiment 8 lies in that, as the second electrode assembly, curved round rod electrodes are used. The application way of various voltages in this embodiment is similar to that in Embodiment 8, for realizing same purpose. With the use of round rod electrodes, a better field form of the RF field may be obtained, and a better ion confining effect is thus achieved.

Embodiment 10

As shown in FIG. 15, the second electrode assembly in this embodiment includes a pair of non-parallel electrode units 10021 and 10022, which are arranged in a plane between the parallel electrode units of the first electrode assembly along an extension of the spatial axis. Similarly, the second electrode assembly may include at least one pair of non-parallel electrode units arranged in a plane between the parallel electrode units of the first electrode assembly along an extension of the spatial axis, in order to satisfy different functional requirements and realize the flexible combination and expansion of various functions.

It is to be noted that, the ion guiding device of the present invention is used as one of preceding-stage ion guiding device, ion compression device, ion storage device, collision cell and ion buncher device of a mass spectrometer, or a combination thereof. In other words, a mass spectrometer may include one or more above-mentioned ion guiding devices, for achieving the corresponding purposes.

As shown in FIG. 16, the ion guiding device of the present invention includes the following steps:

step S1: providing a first electrode assembly, the first electrode assembly including two parallel electrode units arranged along a spatial axis;

step S2: providing a second electrode assembly, the second electrode assembly including at least two non-parallel electrode units arranged in a plane between the parallel electrode units along the spatial axis, wherein a space enclosed by the first electrode assembly and the second electrode assembly forms an ion transmission channel along the spatial axis;

step S3: applying RF voltages with different polarities to the first electrode assembly and the second electrode assembly to generate a RF electric field in the directions perpendicular to the spatial axis to confine ions, and separately applying DC voltages to the first electrode assembly and the second electrode assembly to generate a certain DC voltage difference, so as to generate a DC electric field along the spatial axis to control the movement of ions.

The specific implementations of the ion guiding method of the present invention are as same as the specific implementations and embodiments of the ion guiding device, and will not be repeated here.

In conclusion, in the ion guiding device and the ion guiding method of the present invention, a pair of parallel electrodes arranged along a spatial axis and a pair of non-parallel electrodes forming a certain angle with the spatial axis are included, and the cross-sectional area of an ion transmission channel enclosed by the pair of parallel electrodes and the pair of non-parallel electrodes gradually changes along the spatial axis; moreover, by applying RF voltages with different polarities to the pair of parallel electrodes and the pair of non-parallel electrodes and applying a DC voltage difference between the pair of parallel electrodes and the pair of non-parallel electrodes, a RF electric field in the directions perpendicular to the axial direction may be generated within the ion channel to confine ions, and a DC electric field in the axial direction may also be generated to drive ion transmission. Accordingly, the transmission speed of the ions may be effectively increased, and an off-axis ion optical structure may be realized conveniently. Therefore, the signal-to-noise ratio of the ion guiding device is improved greatly, and the overall length of the instrument is shortened. Furthermore, the structure is simple, and the operation is convenient. Therefore, the present invention effectively overcomes various defects in the prior arts and thus has high industrial utilization value.

The embodiments are merely for illustratively describing the principle and effects of the present invention, and not intended to limit the present invention. Those skilled in the art may make modifications or alterations to the embodiments without departing from the spirit and scope of the present invention. Therefore, all equivalent modifications or alterations made by those skilled in the art without departing from the spirit and technical idea of the present invention shall be embraced by the claims of the present invention.

The invention claimed is:

1. An ion guiding device, comprising:

a first electrode assembly, comprising two parallel electrode units arranged along a spatial axis;

a second electrode assembly, comprising at least two non-parallel electrode units arranged in a plane between the said parallel electrode units along the said spatial axis, wherein a space enclosed by the said first electrode assembly and the said second electrode assembly forms an ion transmission channel along the said spatial axis; and a power supply device configured to apply RF voltages with different polarities to the said first electrode assembly and second electrode assembly to generate a RF electric field in the directions perpendicular to the said spatial axis to confine ions, and separately apply DC voltages to the said first electrode assembly and second electrode assembly to generate a certain DC voltage difference, so as to generate a DC electric field along the spatial axis to control the movement of ions.

2. The ion guiding device according to claim 1, characterized in that the said ion transmission channel has an ion inlet larger than an ion outlet.

3. The ion guiding device according to claim 1, characterized in that the cross-sectional area of the said ion transmission channel gradually changes along the said spatial axis.

4. The ion guiding device according to claim 1, characterized in that the RF voltages applied to the said first electrode assembly and second electrode assembly by the said power supply device are different in at least one of phase, amplitude and frequency.

5. The ion guiding device according to claim 1, characterized in that the waveform of the RF voltages is one of sine wave, square wave, sawtooth wave and triangular wave.

6. The ion guiding device according to claim 1, characterized in that the working pressure range of the ion guiding device is one or more of $[2\times10^5, 2\times10^3]$ Pa, $[2\times10^3, 20]$ Pa, $[20, 2]$ Pa, $[2, 2\times10^{-1}]$ Pa, $[2\times10^{-1}, 2\times10^{-3}]$ Pa and less than $2\times10^{-3}$ Pa.

7. The ion guiding device according to claim 1, characterized in that the said electrode units in the said first electrode assembly are one of plate electrodes, rod electrodes, and thin-layer electrodes attached to a PCB or a ceramic substrate, or a combination thereof.

8. The ion guiding device according to claim 1, characterized in that the said spatial axis is a straight axis, a curved axis or a combination thereof.

9. The ion guiding device according to claim 1, characterized in that, as the said second electrode assembly, round rod electrodes or plate electrodes are used.

10. The ion guiding device according to claim 1, characterized in that the said two parallel electrode units in the first electrode assembly are replaced with a tubular electrode comprising two parallel surfaces.

11. The ion guiding device according to claim 1, characterized in that at least one electrode unit in the said second electrode assembly comprises at least one electrode segment, and the said power supply device applies different DC voltages and a same RF voltage to adjacent electrode segments.

12. The ion guiding device according to claim 1, characterized in that the ion guiding device is used as one of a preceding-stage ion guiding device, an ion compression device, an ion storage device, a collision cell and an ion buncher device of a mass spectrometer, or a combination thereof.

13. The ion guiding device according to claim 1, characterized in that the said second electrode assembly comprises one or more pairs of non-parallel electrode units arranged in a certain plane between the parallel electrode units along the spatial axis.

14. The ion guiding device according to claim 1, characterized in that said parallel electrode units comprise two electrodes, and said non-parallel electrode units comprises two electrodes.

15. An ion guiding method, comprising the following steps of:

providing a first electrode assembly, the first electrode assembly comprising two parallel electrode units arranged along a spatial axis;

providing a second electrode assembly, the second electrode assembly comprising at least two non-parallel electrode units arranged in a plane between the said parallel electrode units along the said spatial axis, wherein a space enclosed by the first electrode assembly and the second electrode assembly forms an ion transmission channel along the said spatial axis;

applying RF voltages with different polarities to the said first electrode assembly and second electrode assembly to generate a RF electric field in the directions perpendicular to the said spatial axis to confine ions, and separately applying DC voltages to the said first electrode assembly and second electrode assembly to generate a certain DC voltage difference, so as to generate a DC electric field along the said spatial axis to control the movement of ions.

16. The ion guiding method according to claim 15, characterized in that an ion inlet of the said ion transmission channel is larger than an ion outlet.

17. The ion guiding method according to claim 15, characterized in that the cross-sectional area of the said ion transmission channel gradually changes along the said spatial axis.

18. The ion guiding method according to claim 15, characterized in that the RF voltages applied to the said first electrode assembly and second electrode assembly are different in at least one of phase, amplitude and frequency.

19. The ion guiding method according to claim 13, characterized in that the waveform of the said RF voltages is one of sine wave, square wave, sawtooth wave and triangular wave.

20. The ion guiding method according to claim 15, characterized in that the working pressure range in the ion guiding method is one or more of $[2\times10^5, 2\times10^3]$ Pa, $[2\times10^3, 20]$ Pa, [20, 2] Pa, $[2, 2\times10^{-1}]$ Pa, $[2\times10^{-1}, 2\times10^{-3}]$ Pa and less than 2×10' Pa.

21. The ion guiding method according to claim 15, characterized in that the electrode units in the said first electrode assembly are one of plate electrodes, rod electrodes, and thin-layer electrodes attached to a PCB or a ceramic substrate, or a combination thereof.

22. The ion guiding method according to claim 15, characterized in that the said spatial axis is a straight axis, a curved axis or a combination thereof.

23. The ion guiding method according to claim 15, characterized in that, as the said second electrode assembly, round rod electrodes or plate electrodes are used.

24. The ion guiding method according to claim 15, characterized in that the two parallel electrode units in the said first electrode assembly are replaced with a tubular electrode comprising two parallel surfaces.

25. The ion guiding method according to claim 15, characterized in that at least one electrode unit in the said second electrode assembly comprises at least one electrode segment, and different DC voltages and a same RF voltage are applied to adjacent electrode segments.

26. The ion guiding method according to claim 15, characterized in that the said second electrode assembly comprises one or more pairs of non-parallel electrode units arranged in a certain plane between the said parallel electrode units along the said spatial axis.

* * * * *